United States Patent [19]

Ritter et al.

[11] Patent Number: 5,042,682

[45] Date of Patent: Aug. 27, 1991

[54] OUTER CONTAINER FOR COMPOSITE DISPENSING PACKAGE

[75] Inventors: Karl M. Ritter, Carol Stream; Noel J. Mertz, Geneva, both of Ill.

[73] Assignee: Container Corporation of America, Clayton, Mo.

[21] Appl. No.: 664,745

[22] Filed: Mar. 5, 1991

[51] Int. Cl.[5] ..... B65D 5/72

[52] U.S. Cl. ..... 220/403; 220/465; 222/185; 222/564; 229/122.2

[58] Field of Search ..... 229/122.1, 122.2; 220/403, 465; 222/105, 185, 547, 564

[56] References Cited

U.S. PATENT DOCUMENTS

| | | | |
|---|---|---|---|
| 1,341,893 | 6/1920 | Fitzgerald | 229/122.1 |
| 1,794,632 | 3/1931 | Luckett | 229/122.2 |
| 3,054,549 | 9/1962 | Humphrey | 220/465 |
| 3,112,047 | 11/1963 | Weinreich et al. | 220/465 |
| 3,227,322 | 1/1966 | Crain | 229/122.1 |
| 3,536,247 | 10/1970 | Gadiel | 229/122.1 |
| 4,039,118 | 8/1977 | Kawaoka | 229/122.1 |
| 4,120,420 | 10/1978 | Dirksing | 229/122.2 |
| 4,673,125 | 6/1987 | Weaver | 220/403 |

*Primary Examiner*—Gary E. Elkins

*Attorney, Agent, or Firm*—Richard W. Carpenter

[57] ABSTRACT

An outer container, formed from a unitary blank of foldable paperboard, for use with an inner flexible bag in a composite package adapted to hold and dispense liquids. The container includes a detachable tab in the bottom wall, to provide access to a bag spout, and an integral, internal, wedge-shaped ramp, formed entirely from material of the bottom wall and adjacent side walls of the container, and which is located adjacent a lower rear corner of the container to help evacuate liquid from a bag positioned within the container.

10 Claims, 1 Drawing Sheet

OUTER CONTAINER FOR COMPOSITE DISPENSING PACKAGE

BACKGROUND OF THE INVENTION

1. Field of the Invention

This invention relates to dispensing containers, and more particularly to an outer container formed of paperboard for use with an inner flexible bag in a composite package designed to hold and dispense liquids.

An essential feature of the invention is the provision of an integral internal ramp located in the lower portion of the container and adapted to help evacuate liquid from a bag positioned within the container.

2. Description of Background Art

A background art search directed to the subject matter of this application conducted in the U.S. Patent and Trademark Office disclosed the following patents:

U.S. Pat. Nos. Re. 25,532, 2,831,610, 2,858,051, 3,002,673, 3,112,047, 3,133,688, 3,227,322, 4,039,118, 4,120,420, 4,356,951, 4,673,125, Germany 2 163 741.

None of the patents uncovered in the background search discloses an outer container adapted to hold an inner flexible bag in a composite dispensing package, wherein the container includes an internal ramp adapted to assist in the dispensing of liquid material from the bag, and wherein the ramp is formed entirely from material of the container bottom and side walls.

SUMMARY OF THE INVENTION

It is an object of the present invention to provide a paperboard outer container for a composite dispensing package comprising the container and an inner flexible bag adapted to hold liquids.

A more specific object of the invention is the provision of an outer container, for a composite package, with a dispensing opening, an inner sloping platform or ramp adapted to facilitate emptying the contents of an inner bag.

An even more specific object of the invention is the provision of a container having an internal platform or ramp that is formed entirely of material of the bottom wall and the adjacent side walls, so as not to require additional paperboard.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

This invention represents an improvement over the invention disclosed in U.S. Pat. No. 4,673,125. Since the integral internal ramp structure of the present invention is formed entirely of material of the bottom and side walls of the container, a substantially lesser amount of paperboard is required to form the container than is required to form the container of U.S. Pat. No. 4,673,125. Thus, the cost of manufacturing the package is reduced significantly.

Figure 4:
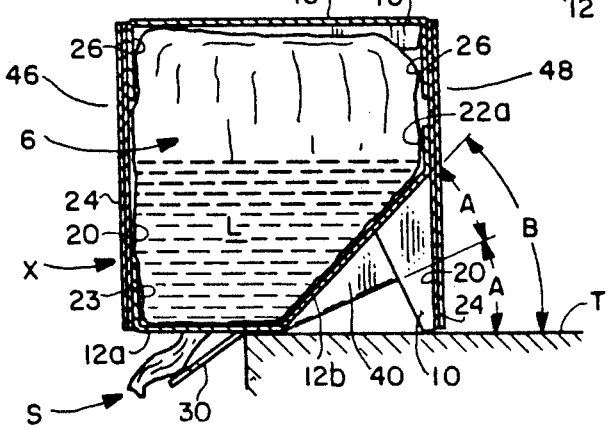
FIG. 4 is a fragmentary side elevational view, with portions of the structure shown in vertical section, illustrating the composite package of the other views, as seen in a liquid dispensing position.

Referring now to the drawings for a better understanding of the invention, and particularly to FIG. 4, it will be seen that there is illustrated a composite package, indicated generally at P, which comprises an outer container or box X, formed from a blank BL of folded sheet material such as paperboard, and an inner flexible bag G that includes an integral dispensing spout S in the lower portion thereof.

In order to dispense liquid from the package, the package is placed on a flat horizontal surface, such as the top of a table T illustrated in FIG. 4, with the forward portion of the package extending beyond the front surface of the table. In this position, the dispensing tab, hereinafter described, can be detached to allow the spout S of the bag to be pulled out through the opening to dispense liquid from the package. The outer container or box X is a generally six-sided, box-like structure which may be formed from the unitary blank BL of foldable sheet material illustrated in FIG. 3 of the drawings.

The main portion or body of the container includes a first side wall 10, a bottom wall 12, a second side wall 14, a top wall 16, and a glue flap 18 which are foldably joined to each other along parallel fold lines 13, 15, 17, and 19, respectively.

Figure 3:
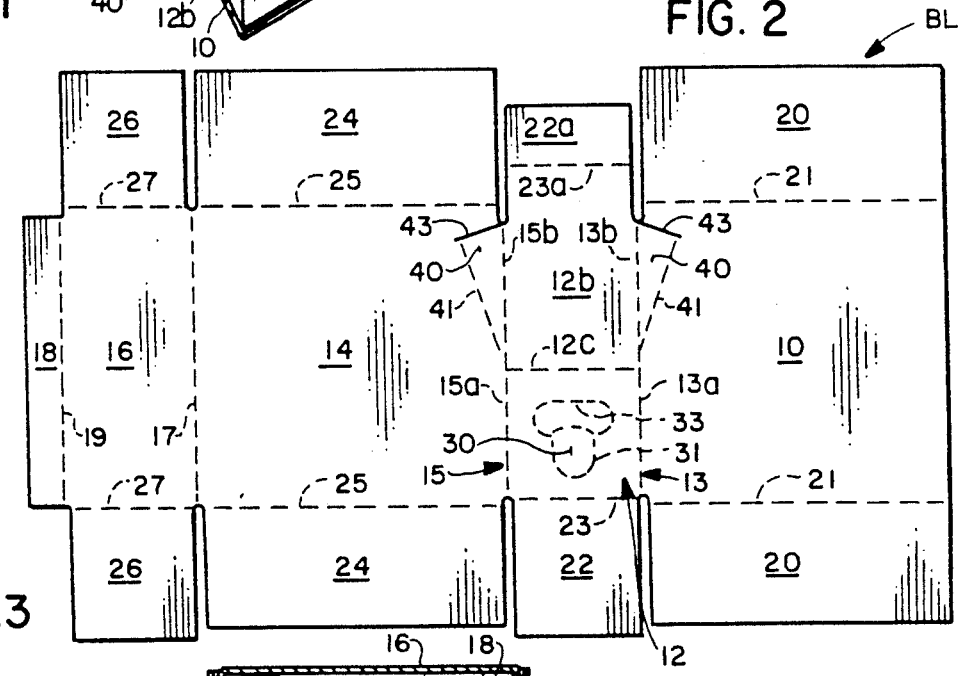
FIG. 3 is a plan view of a blank of foldable sheet material from which the outer container of the package illustrated in the other views may be formed.

As best seen in FIG. 3, bottom wall 12 includes a pair of front and rear panels **12*a* and 12*b*, respectively, which are foldably joined to each other along a fold line 12*c*. Front panel 12*a* is foldably joined to adjacent side walls 10 and 14 along forward portions of the fold lines 13 and 15 which have been designated as 13*a* and 15*a***, respectively.

The front and rear walls of the container 46 and 48, respectively, each include a plurality of closure flaps which are hingedly joined to the body forming panels.

As best seen in FIG. 3, front wall 46 includes overlapping closure flaps 20, 22, 24, and 26, which are foldably joined to the forward edges of body panels 10, 12, 14, and 16 along fold lines 21, 23, 25, and 27, respectively.

Rear wall 48 includes closure panels 20, **22*a*, 24, and 26, which are foldably joined to the rear edges of body panels 10, 12, 14, and 16 on fold lines 21, 23*a*, 25, and 27**, respectively.

It should be noted that fold line 23 joins the forward edge of bottom wall front panel **12*a* to its related closure flap 22; whereas fold line 23*a* joins rear closure flap 22*a* to the rear edge of bottom wall rear panel 12*b*. It should also be noted that closure flap 22*a* is smaller that closure flap 22, and the reason for this is that bottom wall rear panel 12*b*, which forms a ramp or platform, as described later in the specification, extends rearwardly a short distance beyond related side wall panels 10 and 14** when the container is in a collapsed condition.

Figure 1:
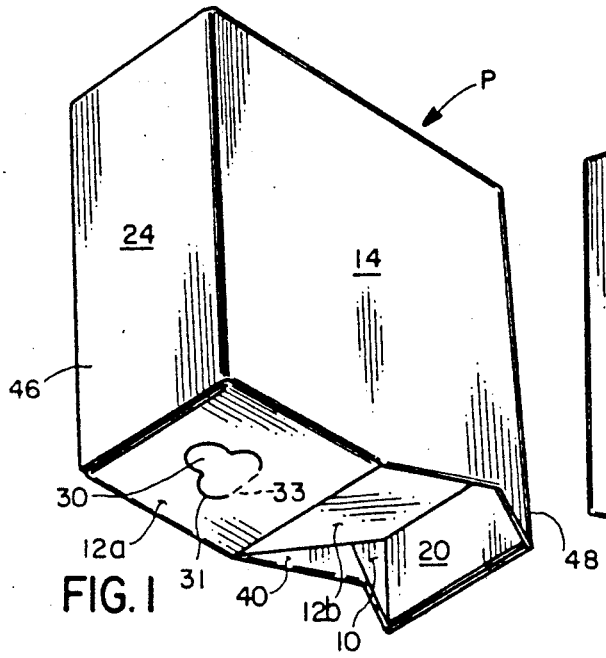
FIG. 1 is a fragmentary perspective view, as seen from the underside, of a composite package embodying features of the present invention.

As best seen in FIGS. 1, 3, and 4, there is provided in front panel **12*a* of the container bottom wall, a readily detachable pull-out tab 30 which is defined by a cut score line 31 and a fold line 33 that hingedly attaches the tab 30 to the bottom wall panel 12***a*.

Although in the preferred embodiment dispensing tab 30 is shown as formed in the bottom wall front panel, if desired the dispensing tab could be located in a lower portion of the container front wall.

As previously mentioned, the essential feature of the present invention is the provision of an integral, internal ramp associated with the bottom wall of the container, the purpose of which is to assist in the evacuation of liquids from the bag positioned within the outer container.

Although in the past, dispensing package outer containers have been provided with internal ramp structures, such structures generally require a substantial amount of additional paperboard, thereby increasing the overall cost of the container. In the present invention, the ramp is formed entirely from material of the bottom wall and adjacent side walls of the container, so the blank from which the container is formed is no larger than a blank used to from a container of similiar size, but without an internal ramp. Thus, the cost of manufacturing the container is substantially reduced.

The ramp includes an upper sloping deck panel, which is the bottom wall rear panel 12*b*, and a pair of generally triangular shaped webs or gussets 40 which are formed from material of the adjacent side wall panels 10 and 14.

Each gusset 40 is defined by a fold line 13*a* or 15*b* which connects the gusset to the bottom wall rear panel, a fold line 41 which connects the gusset to the remaining portion of the related side wall panel, and a cut line 43 extending between the free rearward ends of the gusset fold lines.

In order to form the composite package P, first the front end closure flaps are folded over into overlapping relation and adhesively secured to each other to close the front end of the container, and the filled bag G is inserted into the container through the open rear end.

After this has been done, the container bottom wall rear panel 12*b* is pushed upwardly into the container in order to form the sloping platform or ramp. As this is done the gussets 40 are folded in face-to-face relation with the inner surfaces of the adjacent container side walls 10 and 14.

Figure 2:
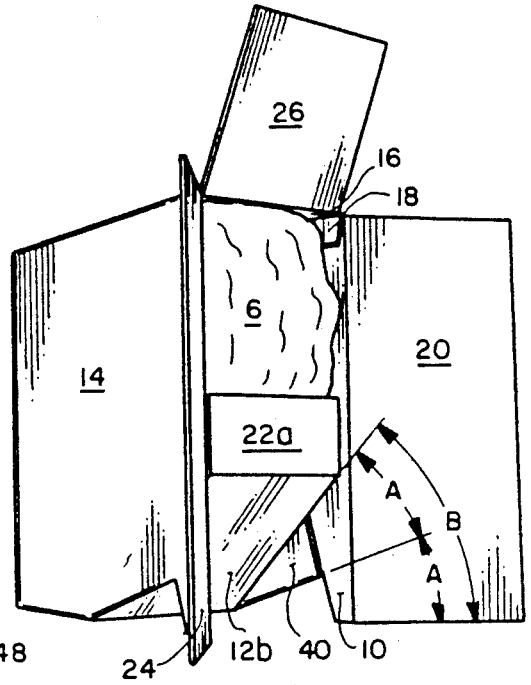
FIG. 2 is a view similar to FIG. 1, but showing the rear of the package just prior to the closing and sealing of the closure flaps that form the container rear wall.

As shown in FIG. 2, the angle A between the score lines of each gusset is approximately 22½ degrees, so that when the gussets are folded 180 degrees against the inner surfaces of the container side walls, the angle B of the bottom wall rear panel or ramp 12*b* with respect to the bottom wall front panel 12*a* is approximately 45 degrees. As a practical matter the angle of the gusset may vary from 15 to 30 degrees, so the angle of the ramp may vary from 30 to 60 degrees.

Thus, it will be appreciated that the invention provides a relatively inexpensive way to form a composite package with an outer container having an integral, internal ramp adapted to assist in the evacuation of liquid from a flexible bag positioned within the outer container.

What is claimed is:

1. An outer container, formed from a unitary blank of paperboard, for use with an inner flexible bag in a composite package adapted to hold and dispense liquids, comprising:

(a) pairs of opposed top and bottom, front and rear, and left and right side walls foldably joined to each other;

(b) said bottom wall including a pair of generally rectangular front and rear panels having remote edges foldably joined to said front and rear walls, respectively, and having adjacent edges foldably joined to each other;

(c) said bottom wall front panel including an integral, partially detachable, dispensing tab located adjacent said front wall, formed from material of said bottom wall front panel, and defined by a weakened line of tear and a fold line;

(d) said outer container including an integral, internal, ramp located adjacent a lower rear corner of the container and arranged and disposed to help evacuate liquid from a bag positioned within the container, said ramp comprising:

(i) a generally rectangular deck panel, formed from material of said bottom wall rear panel, and disposed to slope forwardly and downwardly from said rear wall;

(ii) a pair of generally triangular gussets, formed from material of respective side walls, with each gusset being defined by a pair of rearwardly diverging fold lines foldably joining said gusset to said deck panel and to an adjacent side wall, respectively, and a cut line joining free rear ends of said fold lines, and with each gusset being folded against a related side wall to help support said deck panel.

2. An outer container, formed from a unitary blank of paperboard, for use with an inner flexible bag in a composite package adapted to hold and dispense liquids, comprising:

(a) pairs of opposed top and bottom, front and rear, and left and right side walls foldably joined to each other;

(b) said bottom wall including a pair of generally rectangular front and rear panels having remote edges foldably joined to said front and rear walls, respectively, and having adjacent edges foldably joined to each other;

(c) one of said walls including an integral, at least partially detachable dispensing tab located near the bottom of the container;

(d) said outer container including an integral, internal, ramp located adjacent a lower rear corner of the container and arranged and disposed to help evacuate liquid from a bag positioned within the container, said ramp comprising:

(i) a generally rectangular deck panel, formed from material of said bottom wall rear panel, and disposed to slope forwardly and downwardly from said rear wall;

(ii) a pair of generally triangular gussets formed from material of respective side walls, with each gusset foldably joining said gusset to said deck panel and to an adjacent side wall, respectively, and a cut line joining free rear ends of said fold lines and being folded against a related side wall to help support said deck panel.

3. A blank of foldable paperboard adapted to form an outer container for use with an inner flexible bag in a composite package for holding and dispensing liquids, said blank being cut and scored to provide:

(a) a central body portion including a first side wall panel, a bottom wall panel, a second side wall panel, a top wall panel, and a glue panel foldably joined to each other along parallel first fold lines;

(b) end wall forming panels foldably joined to opposed ends of said top wall, bottom wall, and side wall panels along second fold lines extending normal to said first fold lines;

(c) said bottom wall panel being longer than the other wall panels and including a pair of first and second panel sections foldably joined to each other along a fold line extending parallel to said first fold lines;

(d) said bottom wall first panel including an integral at least partially detachable, dispensing tab;

(e) a pair of generally triangular gussets, formed from material of respective side wall panels, with each gusset being defined by a pair of diverging fold lines that foldably join said gusset to said bottom wall panel second section and to a related side wall panel, respectively, and a cut line joining free rear ends of said diverging fold lines.

4. An outer container according to claim 1, wherein the angle between said diverging fold lines is in the range of from 15 degrees to 30 degrees.

5. An outer container according to claim 2, wherein the angle between said diverging fold lines is in the range of from 15 degrees to 30 degrees.

6. A blank according to claim 3 wherein the angle between said diverging fold lines is in the range of from 15 degrees to 30 degrees.

7. An outer container according to claim 2, wherein said dispensing tab is defined by a weakened line of tear and a fold line.

8. A blank according to claim 3, wherein said dispensing tab is defined by a weakened line of tear and a fold line.

9. An outer container according to claim 2, wherein said dispensing tab is located in said bottom wall front panel.

10. An outer container according to claim 2, wherein said dispensing tab is located in said front wall.

* * * * *